US010160611B2

(12) United States Patent
Tateishi

(10) Patent No.: US 10,160,611 B2
(45) Date of Patent: Dec. 25, 2018

(54) SHEET FEEDING APPARATUS AND IMAGE FORMING APPARATUS

(71) Applicant: CANON KABUSHIKI KAISHA, Tokyo (JP)

(72) Inventor: Satohisa Tateishi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/199,402

(22) Filed: Jun. 30, 2016

(65) Prior Publication Data

US 2017/0008712 A1 Jan. 12, 2017

(30) Foreign Application Priority Data

Jul. 7, 2015 (JP) ..... 2015-136388

(51) Int. Cl.

*B65H 3/56* (2006.01)
*B65H 3/06* (2006.01)
*B65H 3/34* (2006.01)

(52) U.S. Cl.

CPC ..... *B65H 3/0684* (2013.01); *B65H 3/0669* (2013.01); *B65H 3/34* (2013.01); *B65H 3/56* (2013.01); *B65H 2301/4222* (2013.01); *B65H 2403/513* (2013.01); *B65H 2403/53* (2013.01); *B65H 2403/72* (2013.01)

(58) Field of Classification Search

CPC ..... B65H 3/0684; B65H 3/34; B65H 2301/4222; B65H 3/56

See application file for complete search history.

(56) References Cited

U.S. PATENT DOCUMENTS 6,547,235 B2 4/2003 Higaki
7,255,339 B2 * 8/2007 Hung ..... B65H 3/0684 271/121
7,571,905 B2 * 8/2009 Kim ..... B65H 3/0684 271/109
7,686,291 B2 * 3/2010 Miyazawa ..... B65H 3/06 271/117
7,707,415 B2 * 4/2010 Braskich ..... H04L 63/0892 380/270
8,313,097 B2 * 11/2012 Kayama ..... B65H 3/0684 271/117
8,727,338 B2 * 5/2014 Hayakawa ..... B65H 3/0684 271/117
8,860,958 B2 * 10/2014 Ito ..... B65H 3/0684 358/1.12

* cited by examiner

*Primary Examiner* — Luis A Gonzalez

(74) *Attorney, Agent, or Firm* — Canon USA, Inc. I.P. Division

(57) ABSTRACT

Let a point at which a lock member and a leading end positioning member abut against each other when a roller holding member is located at a feeding retracted position be represented by a contact point. A tangential direction of a surface of the leading end positioning member at the contact point is substantially parallel to a direction in which the roller holding member moves to a feeding position from a feeding retracted position.

13 Claims, 8 Drawing Sheets

SHEET FEEDING APPARATUS AND IMAGE FORMING APPARATUS

BACKGROUND OF THE INVENTION

Field of the Invention

The present invention relates to a sheet feeding apparatus applied to an image forming apparatus, such as a facsimile machine, a copier, and a printer, and relates to an image forming apparatus provided with the sheet feeding apparatus.

Description of the Related Art

An image forming apparatus, such as a facsimile, a copier, and a printer, a sheet feeding apparatus, such as a document feeding apparatus and a manual paper feeding apparatus, which feeds stacked documents and recording media (hereafter, "sheets"). A sheet feeding apparatus provided with a leading end positioning member (a sheet regulating unit) for positioning leading ends of a bundle of sheets stacked on a tray is proposed (U.S. Pat. No. 6,547,235).

When a sheet bundle is stacked on a tray, the position of the leading end positioning member is regulated and is fixed by a stopper. A leading end of the sheet bundle is made to abut against the leading end positioning member on the tray to position the leading end of the sheet bundle. The sheet bundle positioned on the tray is fed by a pickup roller. When a sheet is fed by the pickup roller, regulation of the leading end positioning member by the stopper is released and the leading end positioning member is pressed and moved by a sheet fed by the pickup roller.

An exemplary operation of the leading end positioning member is described. The pickup roller is provided to be movable up and down between a feeding retracted position where the pickup roller is separated from the sheet bundle and a feeding position where the pickup roller abuts against an upper surface of the sheet bundle to feed the sheet. When the pickup roller is located at the feeding retracted position, the leading end positioning member engages with the stopper, whereby the leading end positioning member is in a fixed state in which movement is regulated. In the state where the leading end positioning member engages with the stopper and movement of the leading end positioning member is regulated, the leading end of the sheet bundle is made to abut against the leading end positioning member and is positioned on the tray.

When the pickup roller is moved downward from the retracted position to the position where the pickup roller abuts against the upper surface of the sheet bundle on the tray and feeds the sheet, engagement between the leading end positioning member and the stopper is released. This state is a fixing released state where the leading end positioning member is movable. When the pickup roller rotates to feed the sheet, the leading end positioning member is pressed by the fed sheet and the sheet is sent to the downstream.

In a related art configuration, when the sheet bundle is made to abut hard against the leading end positioning member on the tray, the leading end positioning member and the stopper may engage each other excessively firmly, and releasing thereof may be difficult. If the engagement is not released, the leading end positioning member is left in a fixed state in which the movement is regulated by the stopper. Therefore, if the pickup roller feeds the sheet, the fed sheet is disturbed by the leading end positioning member of which engagement is not released, thereby causing a jam.

SUMMARY OF THE INVENTION

According to an aspect of the present invention, a sheet conveyance apparatus, includes: a stacking unit configured to stack sheets thereon; a pickup rotating member configured to send out the sheets stacked on the stacking unit; a rotating member holding unit provided pivotably and configured to hold the pickup rotating member; a driving unit configured to move the rotating member holding unit so that the pickup rotating member is capable of being located at a feeding position where the pickup rotating member feeds a sheet stacked on the stacking unit, and at a feeding retracted position where the pickup rotating member does not feed the sheet stacked on the stacking unit; a feeding rotating member provided downstream of the pickup rotating member in the conveyance direction of the sheet and configured to feed the sheet sent out by the pickup rotating member; a sheet regulating unit provided pivotably in the rotating member holding unit, and capable of being located at a regulating position where the sheet regulating unit locates between the pickup rotating member and the feeding rotating member in a conveyance direction of the sheet to regulate the sheet, and a non-regulating position where the sheet regulating unit does not regulate the conveyance of the sheet from the pickup rotating member to the feeding rotating member; and a pivotabe stopper portion configured to abut against the sheet regulating unit and regulate rotation of the sheet regulating unit, if the rotating member holding unit is located at the feeding retracted position, the stopper portion regulating pivoting of the sheet regulating unit from the regulating position to the non-regulating position, and the stopper portion being pivotable from a position where pivoting of the sheet regulating unit is regulated to a position where pivoting of the sheet regulating unit is not regulated when the rotating member holding unit is made to pivot from the feeding retracted position to the feeding position, wherein the stopper portion abuts, in the sheet conveying direction, against the sheet regulating unit from the side opposite to the stacking unit with respect to the sheet regulating unit, when seen from an axial direction of the pickup rotating member, let a point at which the stopper portion and the sheet regulating unit abut against each other when the rotating member holding unit is located at the feeding retracted position be represented by a contact point and, a moving direction in which the rotating member holding unit moves from the feeding retracted position to the feeding position is a direction substantially parallel to a tangential direction of a tangent of a surface of the sheet regulating unit at the contact point or a direction separating from the tangential direction as the rotating member holding unit moves in the moving direction.

Further features of the present invention will become apparent from the following description of exemplary embodiments with reference to the attached drawings.

DESCRIPTION OF THE EMBODIMENTS

Hereafter, an embodiment of the present invention is described with reference to the drawings. It is to be noted that dimensions, shapes, relative arrangements, and the like of the components described in the embodiment described below should be changed suitably depending on the configuration of the apparatus to which the present invention is applied or various conditions, and the scope of the present invention is not limited to the same.

Figure 1:
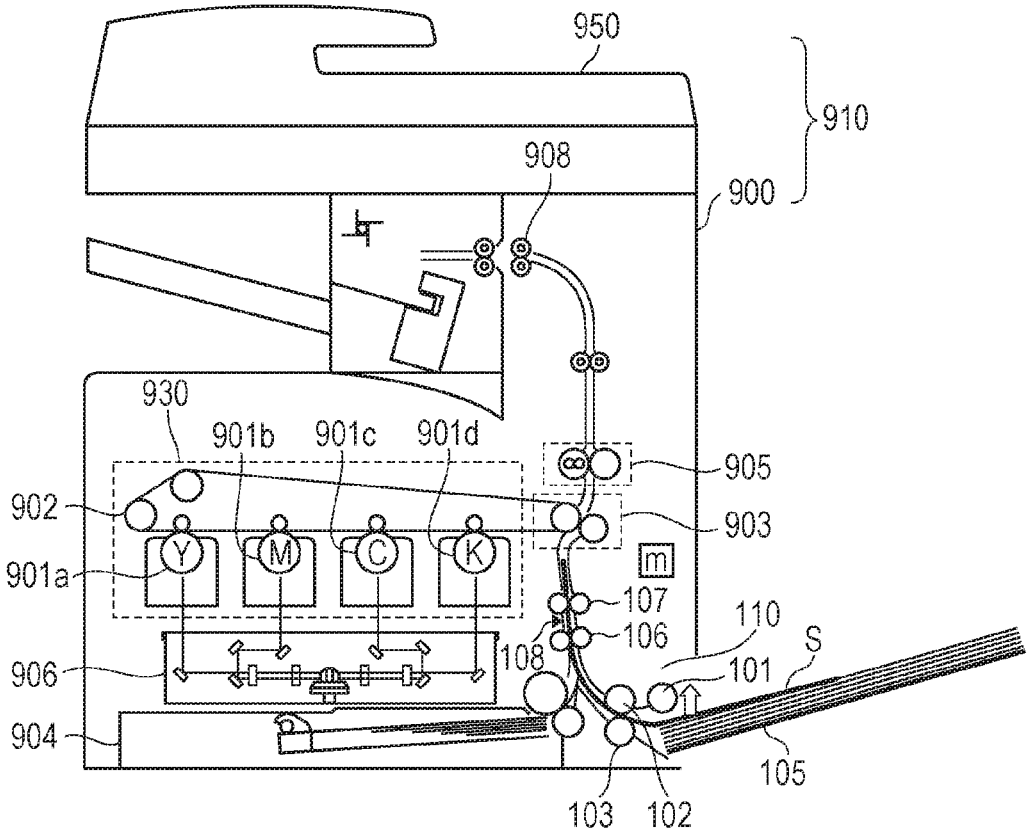
FIG. 1 is a cross-sectional view of an apparatus according to an embodiment of the present invention.

FIG. 1 is a schematic cross-sectional view of an image forming apparatus which is an exemplary embodiment of the present invention. An image forming apparatus 910 includes an image forming apparatus main body 900 and a document conveyance apparatus 950 which reads a document. The image forming apparatus main body 900 includes an image forming unit 930 which forms an image on a recording medium (a sheet), a transfer unit 903, a fixing unit 905, and a discharge unit 908. An image formation process in the image forming unit 930 is described. Each of photoconductive drums 901*a* to 901*d* corresponding to each color of yellow (Y), magenta (M), cyan (C) and black (K) is exposed by an exposure apparatus 906 in accordance with image information, whereby an electrostatic latent image is formed on each of the photoconductive drums 901*a* to 901*d*. The electrostatic latent image on each of the photoconductive drums 901*a* to 901*d* is developed into a toner image of each color by an unillustrated developing apparatus. The toner image of each color is transferred to an intermediate transfer belt 902. In accordance with the toner image, a sheet is fed from a sheet feeding apparatus 110, and the toner image is transferred to the sheet by the transfer unit 903. The sheet to which the toner image is transferred is fixed by the fixing unit 905 and is discharged outside the apparatus by the discharge unit 908. Although the sheet feeding apparatus 110 according to the present embodiment is a manual paper feeding apparatus in which sheets are fed from a manual feed tray, the sheets may alternatively be fed from a cassette 904 provided in the image forming apparatus main body 900.

A pickup roller 101 (a pickup rotating member) is brought into contact with the topmost one of sheets S stacked on a tray 105 (a sheet stacking unit) on which the sheets S are stacked, and sends out the sheet S to a feeding roller 102. The feeding roller 102 (a feeding rotating member) is provided downstream of the pickup roller 101 in a sheet conveying direction, and conveys the sheet S conveyed from the pickup roller 101 downstream. The pickup roller 101 and the feeding roller 102 are connected by an unillustrated gear so that driving force is transmitted to the feeding roller 102 from the pickup roller 101. A separation roller 103 is brought into contact with the feeding roller 102 and, when a plurality of sheets S are conveyed, separates the sheets S one by one. The separation roller 103 is driven to rotate via an unillustrated torque limiter so that the sheet S is fed back toward the tray 105. If two sheets S are held by the feeding roller 102 and the separation roller 103, the sheet S in contact with the separation roller 103 is fed back toward the tray 105 by the rotation of the separation roller 103. If one sheet S is held by the feeding roller 102 and the separation roller 103, the separation roller 103 rotates following the rotation of the feeding roller 102. In the torque limiter described above, torque values for transmitting driving force so as to satisfy these relationships are set.

A drawing roller pair 106 located downstream of the sheet feeding apparatus 110 in the sheet conveying direction conveys the sheet S fed from the sheet feeding apparatus 110 toward the image forming unit 930. A resist roller pair 107 aligns a leading end of the fed sheet S and an end of the toner image formed by the image forming unit 930. A resist sensor 108 detects the position of the sheet S reaching the resist roller pair 107, and conveyance of the sheet S is stopped, at predetermined timing in accordance with the detection. Skew feeding of the sheet S is corrected when the leading end of the sheet S abuts against a nip of the resist roller pair 107.

Figure 2A:
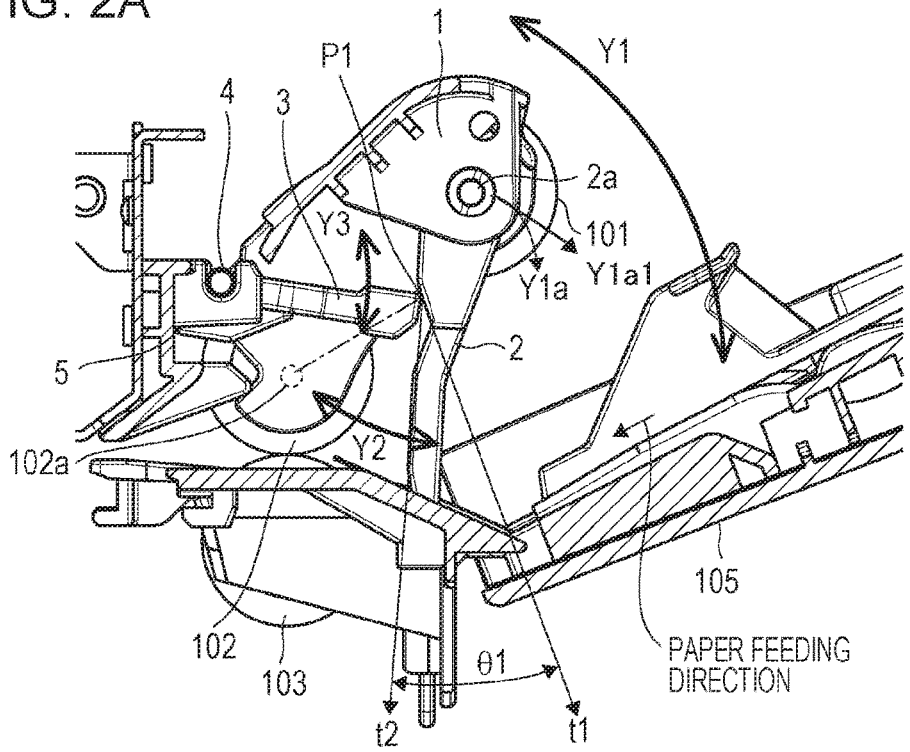
FIG. 2A is a cross-sectional view and FIG. 2B is a perspective view of a configuration according to an embodiment of the present invention.
Figure 2B:
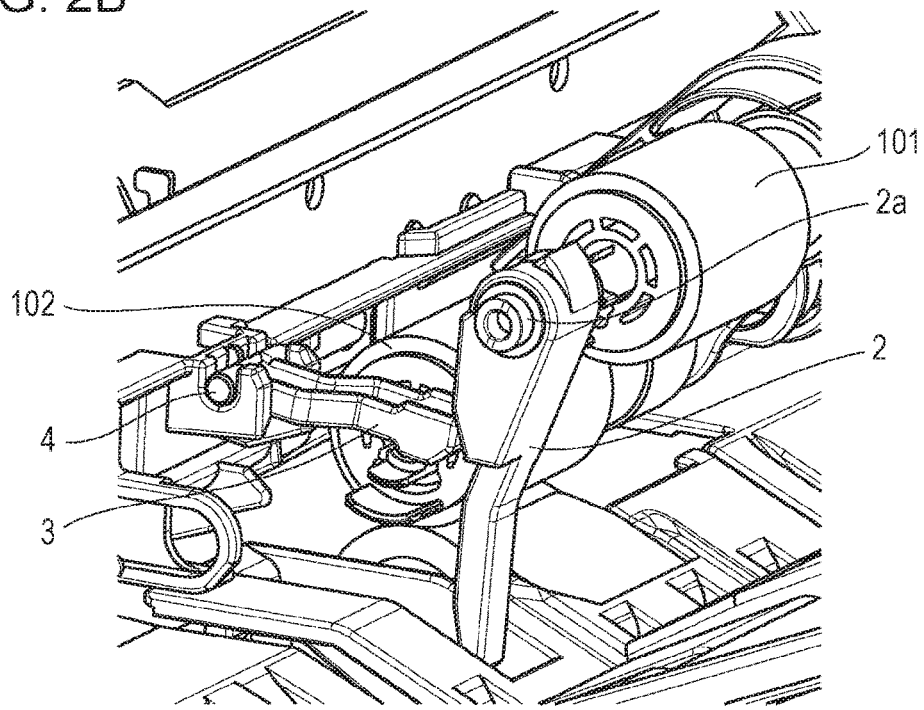

FIGS. 2A and 2B illustrate the sheet feeding apparatus 110 in detail. FIG. 2A is a cross-sectional view of the pickup roller 101 seen from an axial direction. FIGS. 3 to 8 are also cross-sectional views of the pickup roller 101 seen from the axial direction. FIG. 2B is a perspective view of the sheet feeding apparatus 11. In FIG. 2B, a roller holding member 1 (a rotating member holding unit) is not illustrated for the ease of description. FIGS. 2A and 2B illustrate a feeding retracted position at which the pickup roller 101 is moved upward and retracted.

The roller holding member 1 holds the pickup roller 101. The roller holding member 1 is pivotable in a Y1 direction about an axis which is coaxial with the axis 102*a* of the feeding roller 102. The roller holding member 1 pivots up and down by a motor M (see FIG. 1) which is a driving unit controlled by an unillustrated control unit. A leading end positioning member 2 (a sheet regulating unit) is held pivotably by the roller holding member 1, and regulates the positions of the leading ends of the sheets S stacked on the tray 105. The leading end positioning member 2 is pivotable in the Y2 direction about a pivotal center 2*a* which is coaxial with an axis that supports the pickup roller 101. The leading end positioning member 2 may move between a regulating position at which the leading end positioning member 2 projects between the pickup roller 101 and the feeding roller 102 in the sheet conveying direction and regulates the leading end of the sheet S, and a non-regulating position at which the leading end positioning member 2 does not regulate conveyance of the sheet S from the position of the pickup roller 101 to the position of the feeding roller 102.

A lock member 3 (a stopper portion) is attached to a frame of the sheet feeding apparatus 110. The lock member 3 abuts, in the sheet conveying direction, against the leading end positioning member 2 from the side opposite to the side of the tray 105 on which the sheets S are stacked with respect to the leading end positioning member 2. The lock member 3 is pivotable in a Y3 direction about a pivotal center 4. The lock member 3 includes a lock member regulating unit 5 (a pivot regulating unit) with which the posture of the lock member 3 illustrated in FIGS. 2A and 2B is at the lowest pivoting position. When the lock member 3 abuts against the lock member regulating unit 5, clockwise pivoting of the lock member 3 is regulated.

In the state illustrated in FIGS. 2A and 2B, the lock member 3 and the leading end positioning member 2 abut against each other at a contact point P1. A tangential direction of the shape of the leading end positioning member 2 at the contact P1 is denoted by t1, and a pivoting tangential direction of the lock member 3 at the contact point P1 is denoted by t2 in FIG. 2A. A tangential direction herein is a direction of a tangent of a curved surface if the shape of the leading end positioning member 2 at the contact point P1 is a curved surface, and is an extension of a plane if the shape of the leading end positioning member 2 at the contact point P1 is a plane. A pivoting tangential direction herein is a tangential direction of a circle about a pivotal center, and is a tangential direction at the contact point P1 of a circle about the axis 102*a* of the feeding roller 102 which crosses the contact point P in the present embodiment.

Next, an operation of the present embodiment is described.

Figure 5A:
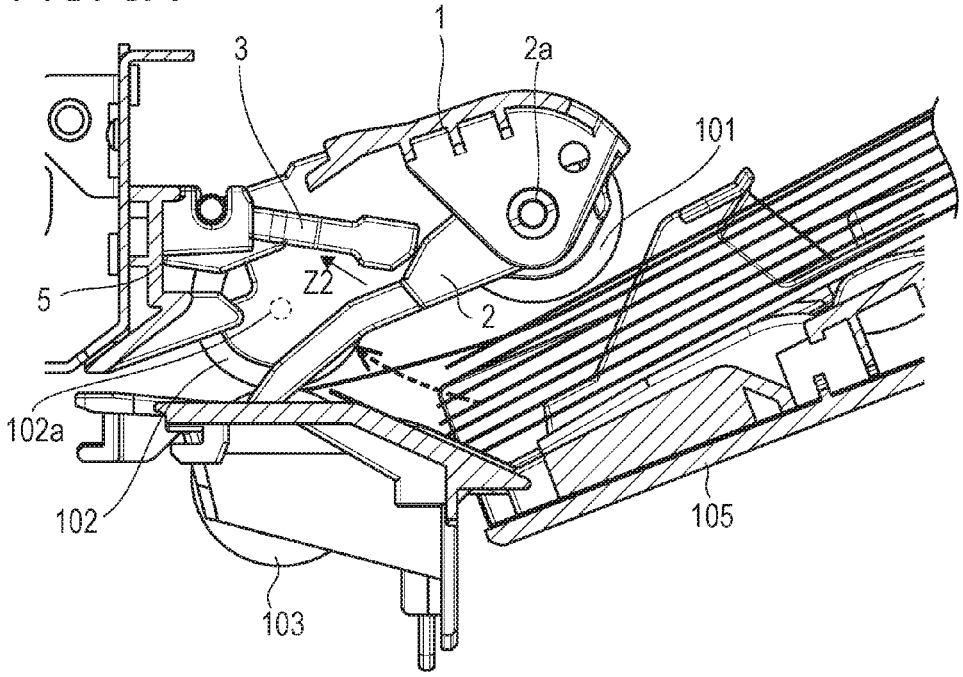
FIGS. 5A and 5B are cross-sectional views illustrating an operation according to an embodiment of the present invention.
Figure 5B:
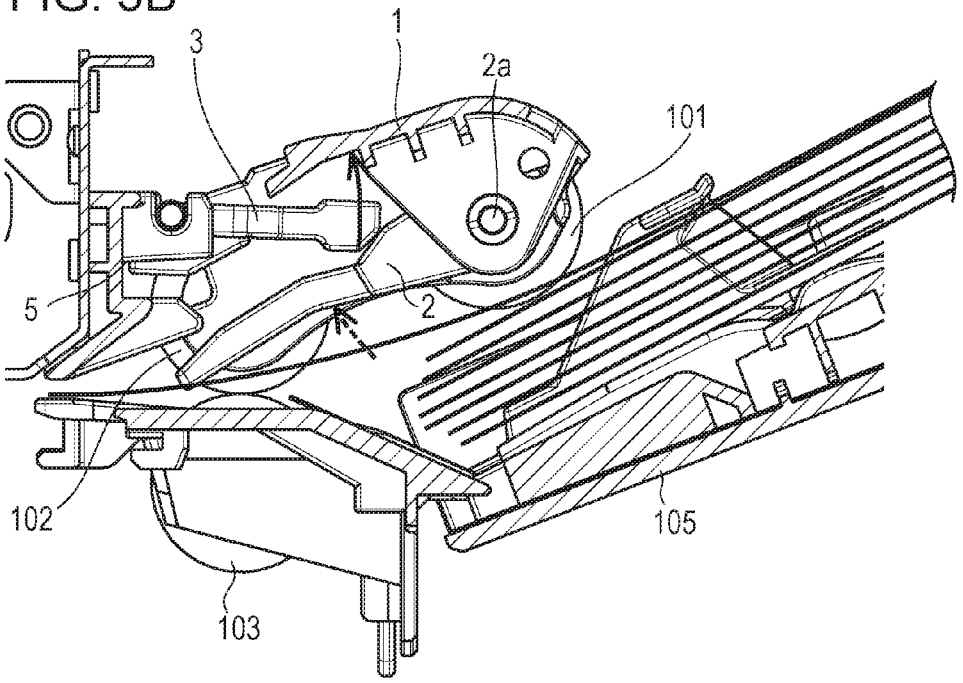

The roller holding member 1 is rotated by the control unit and the motor M, and the pickup roller 101 is moved between a feeding retracted position (see FIGS. 2A and 2B) at which the pickup roller 101 is moved upward and retracted and a feeding position (see FIGS. 1A and 5B) at which the pickup roller 101 is moved downward and is ready for feeding the sheet S. The feeding position in the height direction of the pickup roller 101 changes depending on the amount of the sheets S stacked on the tray 105. Regarding the roller holding member 1 and the leading end positioning member 2, each of the states illustrated in FIGS. 2A and 2B is at the feeding retracted position, and each of the states illustrated in FIGS. 5A and 5B is at the feeding position.

At the feeding retracted position of the pickup roller 101, the leading end positioning member 2 hangs down by self-weight, and the lock member 3 is positioned by self-weight and the lock member regulating unit 5. Therefore, the leading end positioning member 2 and the lock member 3 take the postures illustrated in FIGS. 2A and 2B. An angle formed by a tangential direction t1 and the pivoting tangential direction t2 at the contact point P1 is represented by a contact angle θ1 in FIG. 2A.

The shape of the leading end positioning member 2 is determined such that the tangential direction t1 forms an angle smaller than 90° (preferably, substantially perpendicular) with a line connecting the contact point P1 and the axis 102*a* of the feeding roller 102 (the pivotal center of the roller holding member 1). The contact angle θ1 formed by the tangential direction t1 and the pivoting tangential direction t2 is preferably about 5 to 45°, and is set to be 27° in the present embodiment.

Figure 3:
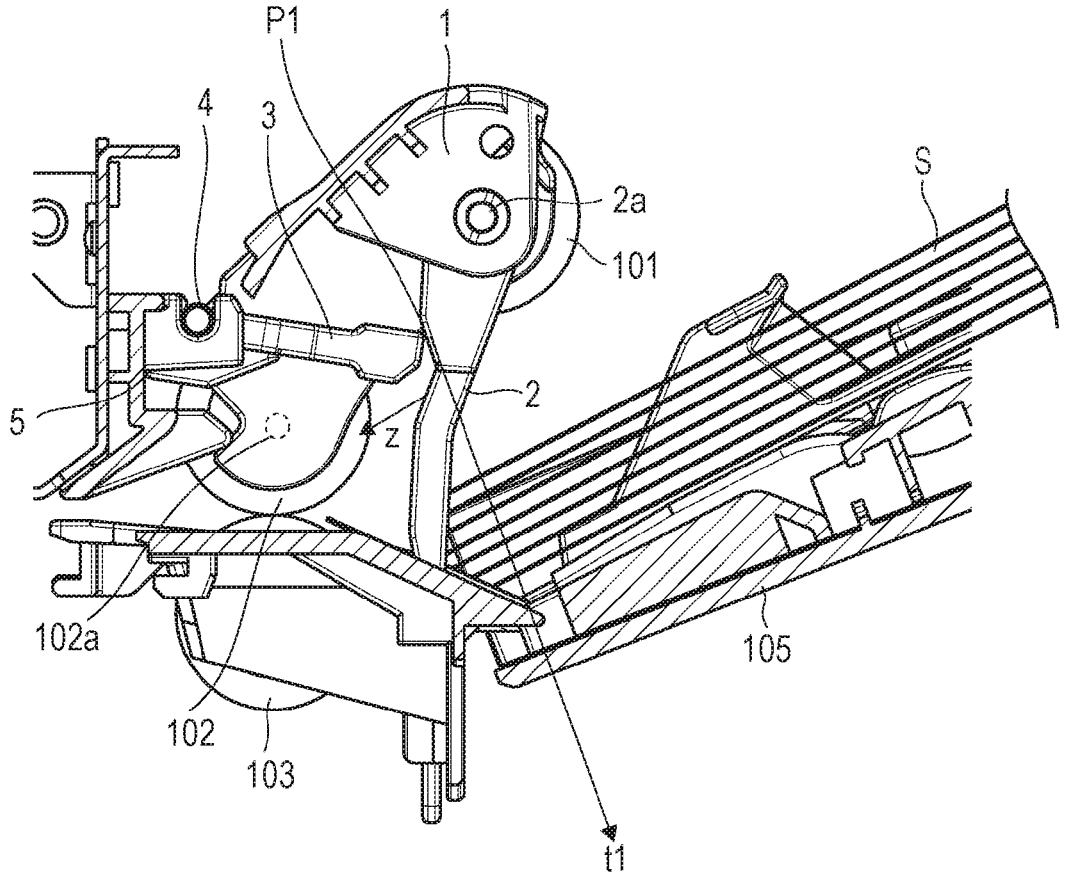
FIG. 3 is a cross-sectional view of a configuration according to an embodiment of the present invention.

FIG. 3 is a diagram illustrating a state where the sheets S are stacked on the tray 105 and the leading ends of the sheets S abut against the leading end positioning member 2.

In FIG. 3, when the sheets S abut against the leading end positioning member 2, the abutting force by the sheets S is applied to a direction in which the leading end positioning member 2 is moved clockwise. Here, contact force at the contact point P1 is denoted by z in FIG. 3.

The direction of the contact force z is substantially perpendicular to the tangential direction t1. The tangential direction t1 and the pivoting tangential direction t2 of the lock member 3 forms the contact angle θ1. Therefore, the contact force z generates force (moment) in the clockwise direction with respect to the lock member 3.

However, even if the lock member 3 receives force in the clockwise direction, since the lock member 3 is regulated by the lock member regulating unit 5 with which the posture of the lock member 3 illustrated in FIGS. 2A and 2B is at the lowest pivoting position, the lock member 3 does not pivot. That is, when the leading end positioning member 2 receives force in the clockwise direction as illustrated in FIG. 3 from a bundle of the sheets S set on the tray 105, the lock member 3 tries to rotate clockwise with the force in the clockwise direction applied by the leading end positioning member 2, but movement is regulated by the lock member regulating unit 5. The leading end positioning member 2 is not moved by the lock member 3 which is regulated by the lock member regulating unit 5. Therefore, when the sheets S abut against the leading end positioning member 2, the leading end positioning member 2 may keep the posture as illustrated in FIG. 3, and may align the leading ends of the sheets S favorably.

Next, a state shift of the pickup roller 101 from the feeding retracted position to the feeding position is described.

Figure 4:
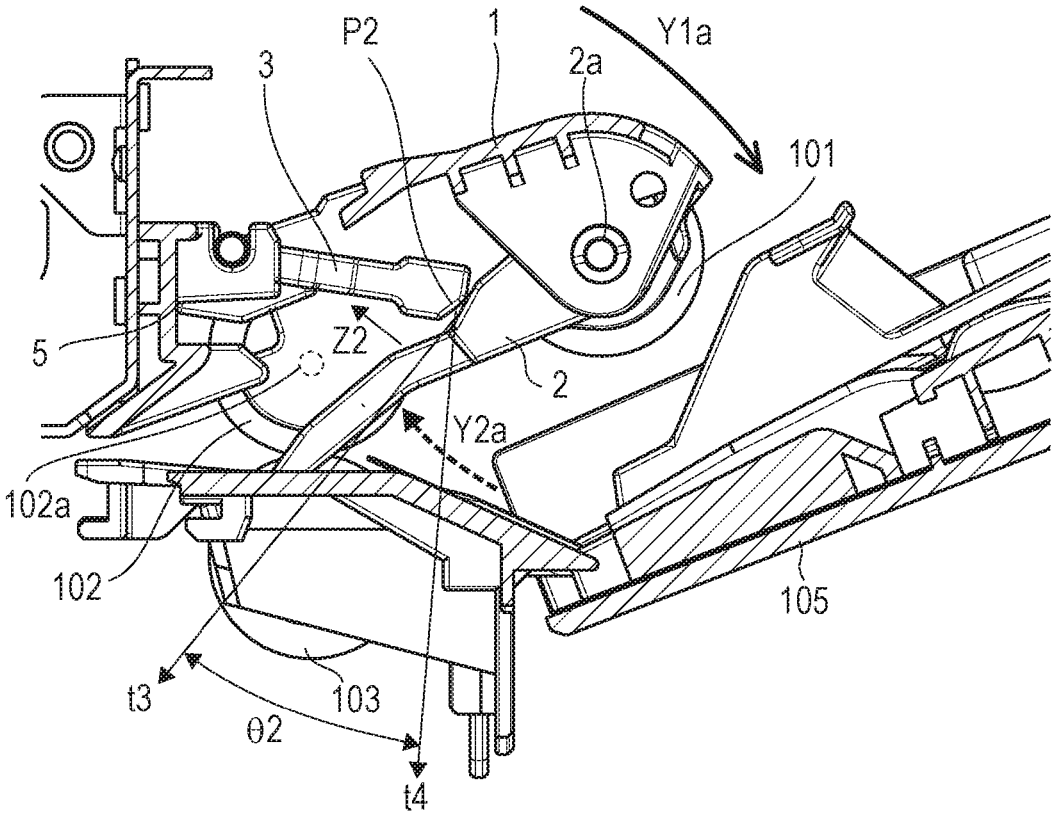
FIG. 4 is a cross-sectional view illustrating an operation according to an embodiment of the present invention.

When the roller holding member 1 is moved downward in a Y1*a* direction by the motor MI the pickup roller 101 held by the roller holding member 1 pivots in the Y1*a* direction. Then, since regulation by the lock member 3 is released, the leading end positioning member 2 is pressed by the conveyed sheet S and becomes pivotable in a Y2*a* direction (FIG. 4). Release of regulation of the leading end positioning member 2 by the lock member 3 is described in more detail.

As illustrated in FIGS. 2A and 2B, since the pickup roller 101 moves in the Y1*a* direction along a circle about the axis 102*a* of the feeding roller 102, the pivotal center 2*a* in which the leading end positioning member 2 is attached to the roller holding member 1 is also moved in the Y1*a* direction along the circle. The Y1*a* direction in which the leading end positioning member 2 moves is the direction to separate from the tangent at the contact point P1. Since the leading end positioning member 2 is pivotably supported coaxially with the axis 102*a* of the feeding roller 102, the leading end positioning member 2 moves in the direction separating from the lock member 3. Therefore, the lock member 3 does not disturb the downward pivoting of the roller holding member 1, and regulation of the leading end positioning member 2 by the lock member 3 is released. With this configuration, even if the leading end positioning member 2 and the lock member 3 engage each other excessively firmly when the roller holding member 1 pivots downward, since the leading end positioning member 2 moves in the direction to separate from the lock member 3, regulation may be released easily even if the engagement is excessively firm. A preferred range of angles formed by the tangential direction t1 and the tangential direction of the moving direction Y1*a*1 is from substantially parallel angle (0 degree) to 20°.

FIG. 4 illustrates a state where the roller holding member 1 is moved downward and the leading end positioning member 2 is acting force to the lock member 3 in the direction to move the lock member 3 upward. When the roller holding member 1 is moved downward, the leading end positioning member 2 is also moved downward. Then, the normal line of the leading end positioning member 2 at a contact point P2 of the leading end positioning member 2 and the lock member 3 faces up. Therefore, when the leading end positioning member 2 tries to rotate clockwise, a direction of force Z2 acting on the lock member 3 also faces up, and the lock member 3 receives force (moment) to pivot counterclockwise.

Detailed description is given. A tangential direction of the leading end positioning member 2 at the contact point P2 is denoted by t3. A pivoting tangential direction of the lock member 3 at the contact point P2 is denoted by t. An angle formed by a tangential direction t3 and the pivoting tangential direction t4 at the contact point P2 is represented by a contact angle θ2.

Here, it is assumed that a contact angle in a case where the tangential direction t1 (or t3) of the leading end positioning member 2 is located at a counterclockwise position with respect to the pivoting tangential direction t2 (or t4) of the lock member 3 has a positive value. Then, as illustrated in FIGS. 2A and 2B, when the tangential direction t1 of the leading end positioning member 2 is located at the counterclockwise position with respect to the pivoting tangential direction t2 of the lock member 3, the contact angle θ1 is greater than 0 and thus has a positive value. As illustrated in FIG. 4, when the tangential direction t3 of the leading end positioning member 2 is located at the clockwise position with respect to the pivoting tangential direction t4 of the lock member 3, the contact angle θ2 is smaller than 0 and thus has a negative value.

As is understood from the fact that the sign of the contact angle θ2 is inverted from that of the contact angle θ1, when the leading end positioning member 2 is made to pivot clockwise in the state illustrated in FIG. 4, the contact force Z2 at the contact point P2 becomes force (moment) to make the lock member 3 pivot counterclockwise. During counterclockwise rotation of the lock member 3, since no force other than self-weight is applied to the lock member 3 in the clockwise direction, the lock member 3 pivots easily with small force.

Next, movement of each part during conveyance of the sheet S is described.

FIG. 5A illustrates an operation in which the pickup roller 101 located at the feeding position feeds the topmost sheet S of a bundle of sheets S stacked on the tray 105.

As illustrated in FIG. 5A, when the sheet S is conveyed downstream in the conveying direction by the pickup roller 101, the leading end of the sheet S abuts against the leading end positioning member 2 and makes the leading end positioning member 2 pivot clockwise.

When the leading end positioning member 2 abuts against the lock member 3, force to press the leading end positioning member 2 by the sheet S becomes the contact force Z2 at the contact point P2 and press the lock member 3 upward. As described above, at the feeding position of the pickup roller 101, the contact force Z2 becomes the force to make the lock member 3 pivot clockwise, and no force other than self-weight is applied to the lock member 3 in the counterclockwise direction. Therefore, the lock member 3 pivots easily with small force.

Therefore, the lock member 3 pivots upward with significantly small force, whereby regulation on pivoting of the leading end positioning member 2 may be released. When the leading end of the sheet S sent out by the pickup roller 101 presses the leading end positioning member 2 upward in the clockwise direction, the sheet S is conveyed downstream (FIG. 5B).

Figure 6:
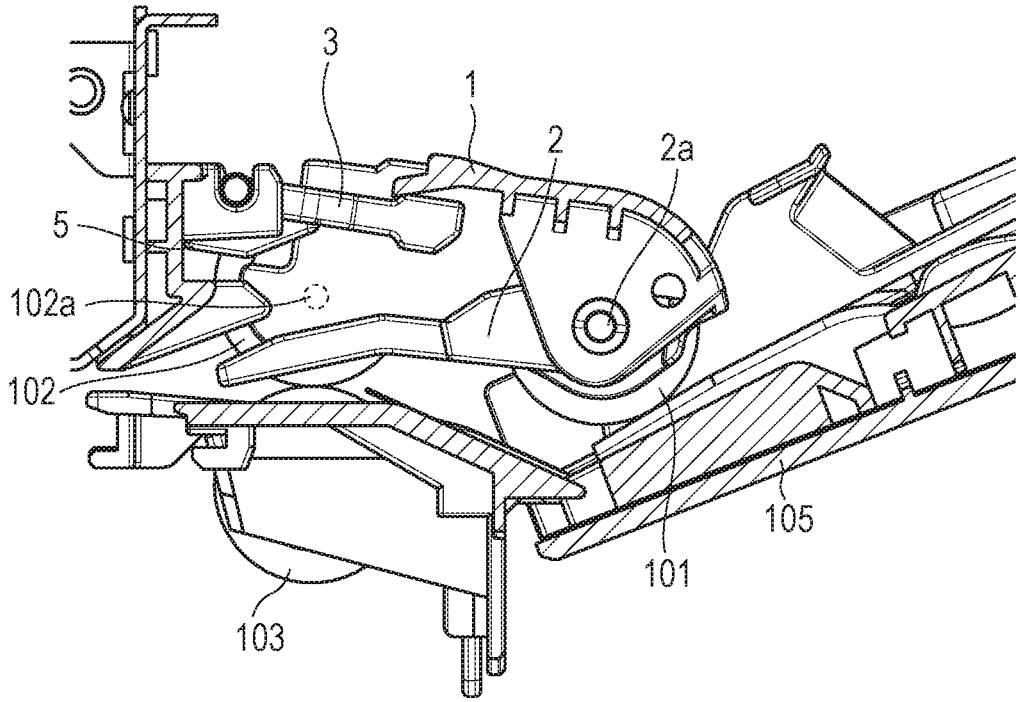
FIG. 6 is a cross-sectional view illustrating an operation according to an embodiment of the present invention.

As the number of stacked sheets S on the tray 105 decreases, the roller holding member 1, and the pickup roller 101 and the leading end positioning member 2 held by the roller holding member 1 are moved downward. FIG. 6 illustrates a state where the feeding operation of the last sheet S stacked on the tray 105 has been completed. Since downward pivoting of the lock member 3 is regulated by the lock member regulating unit 5 as described above, the leading end positioning member 2 and the lock member 3 are separated completely.

Next, a state shift of the pickup roller 101 from the feeding position to the feeding retracted position is described.

After the feeding operation is completed, the roller holding member 1 is made to pivot upward by the motor 14 controlled by the unillustrated control unit, and both the pickup roller 101 and the leading end positioning member 2 held by the roller holding member 1 are also moved upward.

Figure 7:
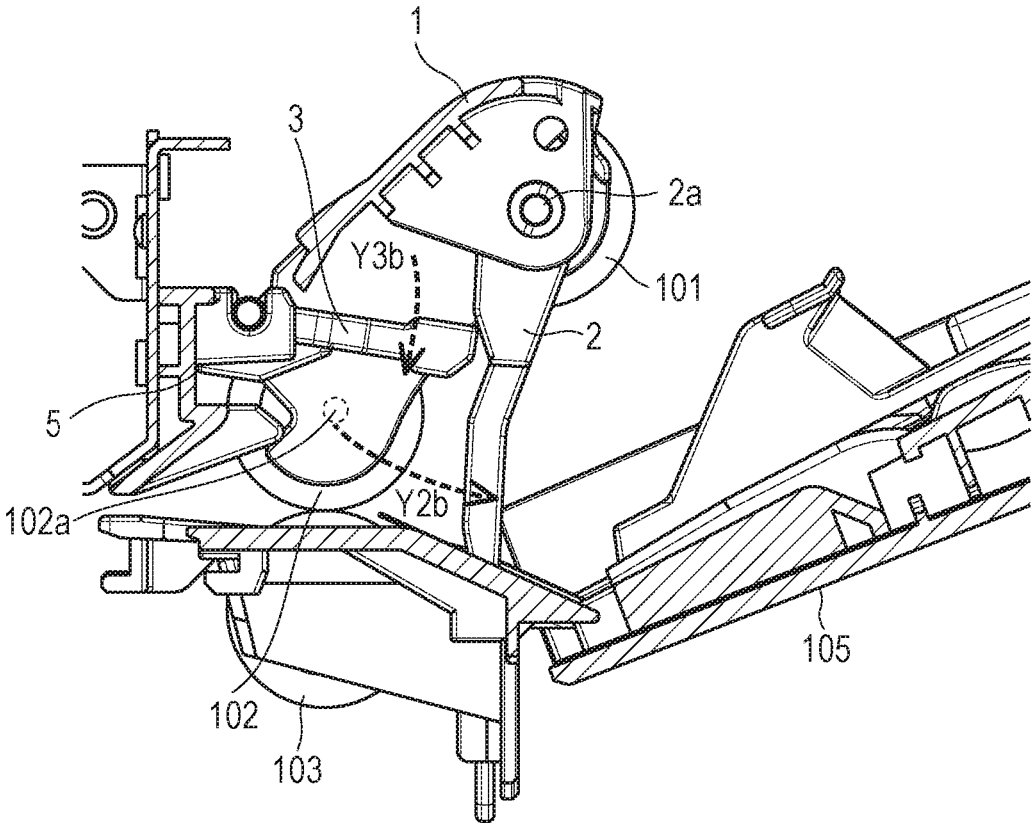
FIG. 7 is a cross-sectional view illustrating an operation according to an embodiment of the present invention.

FIG. 7 is a diagram illustrating a state where no sheet S remains on the tray 105. If the leading end of the sheet S is located upstream in the conveyance direction of the feeding retracted position of the leading end positioning member 2, the state becomes the same as that illustrated in FIG. 7. As illustrated in FIG. 7, the leading end positioning member 2 is made to pivot by self-weight in a Y2*b* direction, and the lock member 3 is made to pivot by self-weight in a Y3*b* direction. Then the leading end positioning member 2 restores to the initial state (FIGS. 2A and 2B).

Figure 8:
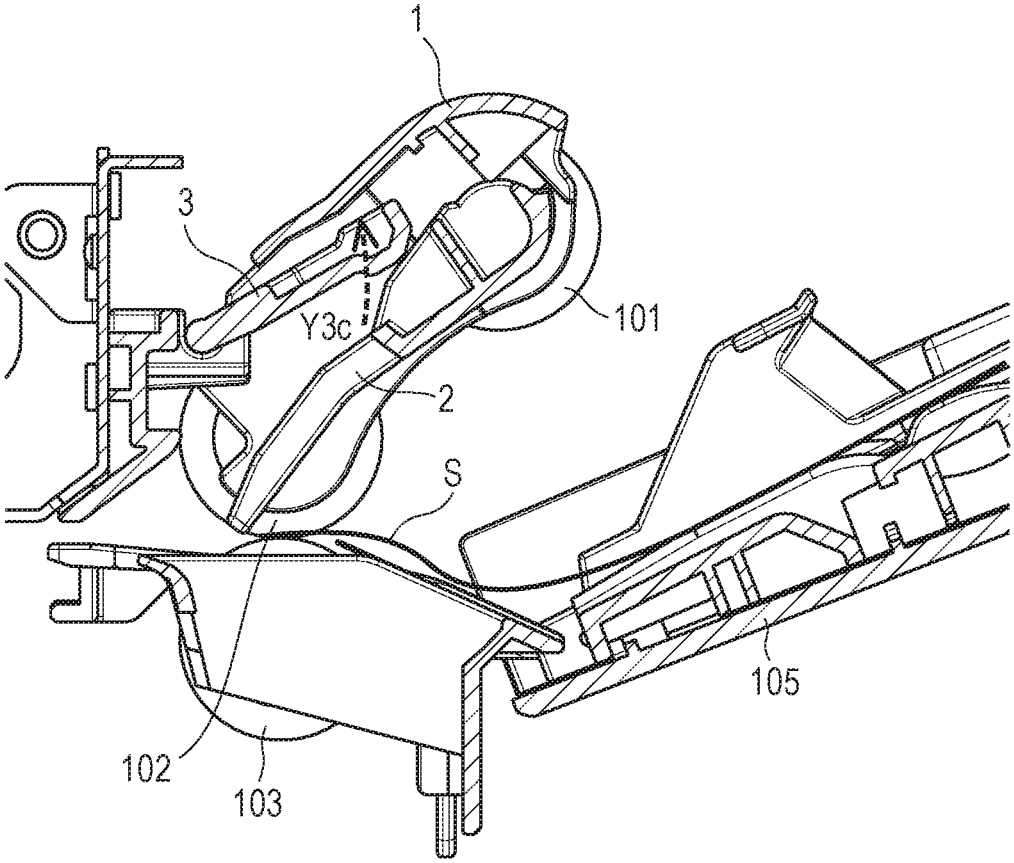
FIG. 8 is a cross-sectional view illustrating an operation according to an embodiment of the present invention.

Here, a case where a jam occurs during feeding of the sheet S is described. FIG. 8 is a diagram illustrating a case where the leading end of the sheet S remaining on the tray 105 remains downstream in the conveying direction of the leading end positioning member 2 (for example, if the leading end of the sheet S is stopped at a nip portion of the feeding roller 102 and the separation roller 103) due to, for example, a jam during feeding of the sheet S.

Since pivoting of the leading end positioning member 2 in the Y2*b* direction is disturbed by the sheet S, the leading end positioning member 2 has not returned to the feeding retracted position. Therefore, pivoting of the look member 3 in the Y3*b* direction is also disturbed.

In this state, when the pickup roller 101 is moved from the feeding position to the feeding retracted position, as illustrated in FIG. 8, the end of the leading end positioning member 2 is kept held by the leading end of the sheet S, and the lock member 3 is made to pivot in a Y3*c* direction as the leading end positioning member 2 is moved upward. By making the lock member 3 pivot in the Y3*c* direction, the leading end positioning member 2 may move to the feeding retracted position without providing any stress to the leading end of the sheet S.

When the sheet S is removed from the tray 105 from this state, as illustrated in FIG. 7, the leading end positioning member 2 is made to pivot by self-weight in the Y2*b* direction, and the lock member 3 is made to pivot by self-weight in the Y3*b* direction. Then the leading end positioning member 2 restores to the initial state (FIGS. 2A and 2B).

If the lock member 3 does not pivot in the Y3*c* direction by self-weight, it is necessary to urge the lock member 3 toward a position as illustrated in FIGS. 2A and 2B by an urging member, such as a spring. With the configuration using the urging member, the leading end positioning member 2 is compulsorily returned to the posture illustrated in FIGS. 2A and 2B by the lock member 3 urged by the urging member. This may cause a problem that the sheet S of which leading end is located close to the feeding roller 102 and the leading end positioning member 2 abut hard against each other to damage, e.g., scratch, the sheet S.

Effects of the Present Embodiment are Described

In the configuration described as a related art, if a sheet is made to abut hard against a leading end positioning member, the leading end positioning member and an engaging portion of an end stopper may engage each other excessively firmly, and releasing thereof may become difficult. If such a phenomenon occurs, since the leading end positioning member is still engaged by the stopper, feeding of the sheet, even if it is tried, is disturbed by the leading end positioning member, which may cause a jam.

According to the present embodiment, in the state where the leading end positioning member 2 is fixed to a position at which the sheet S abuts against the leading end positioning member 2, the tangential direction t and the moving direction (Y1*a*) of the leading end positioning member 2 at the contact point P1 are substantially the same or separating from each other as the pickup roller 101 is moved downward (FIGS. 2A and 2B). The direction in which the leading end positioning member 2 pivots following the state shift of the pickup roller 101 from the feeding retracted position to the feeding position is the direction to release the locked state of the lock member 3 (FIG. 4). Therefore, the lock member 3 releases engagement of the leading end positioning member 2 with small force following the state shift of the pickup roller 101 from the feeding retracted position to the feeding position. Therefore, occurrence of a jam due to non-release of engagement of the leading end positioning member 2 may be avoided. The lock member 3 abuts, in the sheet conveying direction, against the leading end positioning member 2 from the side opposite to the side of the tray 105 on which the sheets S are stacked with respect to the leading end positioning member 2. With this configuration, when the sheet S abuts against the leading end positioning member 2, the force applied to the roller holding member 1 via the leading end positioning member 2 is in the direction to rotate the roller holding member 1 clockwise (Y1*a* in FIG. 4) (the direction in which the pickup roller 101 moves from the feeding retracted position to the feeding position). Therefore, the force applied to the roller holding member 1 via the leading end positioning member 2 does not become force to prevent the pickup roller 101 from moving from the feeding retracted position to the feeding position.

In the present embodiment, a sheet feeding apparatus using a manual feed tray of recording media is described as an exemplary sheet feeding apparatus, but the described apparatus is not restrictive. The present embodiment is applicable also to a sheet feeding apparatus which feeds a recording medium from the cassette 904, or a sheet feeding apparatus which feeds a document of the document conveyance apparatus 950.

In the present embodiment, a sheet feeding apparatus applied to an electrophotographic image forming apparatus is described as an exemplary sheet feeding apparatus, but the described apparatus is not restrictive. The sheet feeding apparatus of the present embodiment is applicable also to a sheet feeding apparatus provided in, for example, an inkjet image forming apparatus which ejects ink on a paper sheet to form an image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-136388, filed Jul. 7, 2015, which is hereby incorporated by reference herein in its entirety.

What is claimed is:

1. A sheet conveyance apparatus, comprising:

a stacking unit configured to stack sheets thereon;

a pickup rotating member configured to send out the sheets stacked on the stacking unit;

a rotating member holding unit configured to hold the pickup rotating member;

a driving unit configured to move the rotating member holding unit so that the pickup rotating member is capable of being located at a feeding position where the pickup rotating member feeds a sheet stacked on the stacking unit, and at a feeding retracted position where the pickup rotating member does not feed the sheet stacked on the stacking unit;

a feeding rotating member provided downstream of the pickup rotating member in a conveyance direction of the sheet and configured to feed the sheet sent out by the pickup rotating member;

a sheet regulating unit pivotably attached to the rotating member holding unit at a first pivot point and configured to regulate the sheet stacked on the stacking unit; and a stopper portion configured to pivot at a second pivot point and abut against the sheet regulating unit below the first pivot point, from a side opposing the stacking unit with respect to the sheet regulating unit in a conveyance direction, the stopper portion further configured to regulate rotation of the sheet regulating unit about the first pivot point, wherein when the pickup rotating member is moved from the feeding retracted position to the feeding position, the first pivot point of the sheet regulating unit moves away from the second pivot point of the stopper portion.

2. The sheet conveyance apparatus according to claim 1, further comprising a pivot regulating unit configured to regulate pivoting of the stopper portion, wherein when the rotating member holding unit is located at the feed retracted position, the stopper portion is located at a position where pivoting thereof is regulated by the pivot regulating unit.

3. The sheet feeding apparatus according to claim 1, wherein a pivotal center of the stopper portion is located downstream in the sheet conveying direction of an end of the stopper portion.

4. The sheet feeding apparatus according to claim 2, wherein in the state where the rotating member holding unit is located in the feeding retracted position, contact force applied to the stopper portion from the sheet regulating unit when the sheet regulating unit abuts against the stopper portion is force in a direction to move the stopper portion toward the pivot regulating unit.

5. The sheet feeding apparatus according to claim 2, wherein a contact force applied to the stopper portion from the sheet regulating unit while the rotating member holding unit moves to the feeding position from the feeding retracted position is force in a direction to separate the stopper portion from the pivot regulating unit.

6. The sheet feeding apparatus according to claim 1, wherein when seen from an axial direction of the pickup rotating member, let a point at which the stopper portion and the sheet regulating unit abut against each other when the rotating member holding unit is located at the feeding retracted position be represented by a contact point P1, let a pivoting tangential direction of the stopper portion at the contact point P1 be denoted by t2, let a tangential direction of a surface of the sheet regulating unit at the contact point P1 be denoted by t1, let an angle formed by t1 and t2 be denoted by θ1, when the rotating member holding unit is on the way from the feeding retracted position to the feeding position, let a point at which the stopper portion and the sheet regulating unit abut against each other be represented by a contact point P2, let a pivoting tangential direction of the stopper portion at the contact point P2 be denoted by t4, let a tangential direction of a surface of the sheet regulating unit at the contact point P2 be denoted by t3, let an angle formed by t3 and t4 be denoted by θ2, and suppose that an angle in a state where the tangential direction of the sheet regulating unit is located at a counterclockwise position with respect to the pivoting tangential direction of the stopper portion is a positive value, θ1>0 and

θ2<0 are satisfied.

7. The sheet feeding apparatus according to claim 1, wherein, let a point at which the stopper portion and the sheet regulating unit abut against each other when the rotating member holding unit is located at the feed retracted position be represented by a contact point P1, an angle formed by a tangential direction t1 of a surface of the sheet regulating unit at the contact point P1 and a direction Y1*a*1 in which the rotating member holding unit moves from the feed retracted position to the feed position is 0 to 20°.

8. The sheet feeding apparatus according to claim 1, wherein the stopper portion is movable by self-weight from a position where pivoting of the sheet regulating unit is not regulated to a position where pivoting of the sheet regulating unit is regulated.

9. An image forming apparatus, comprising:

a sheet feeding apparatus configured to feed a sheet; and an image forming unit configured to form an image on the sheet fed by the sheet feeding apparatus, wherein the sheet feeding apparatus includes a stacking unit configure to stack sheets thereon;

a pickup rotating member configured to send out the sheets stacked on the stacking unit;

a rotating member holding unit configured to hold the pickup rotating member;

a driving unit configured to move the rotating member holding unit so that the pickup rotating member is capable of being located at a feeding position where the pickup rotating member feeds a sheet stacked on the stacking unit, and at a feeding retracted position where the pickup rotating member does not feed the sheet stacked on the stacking unit;

a feeding rotating member provided downstream of the pickup rotating member in a conveyance direction of the sheet and configured to feed the sheet sent out by the pickup rotating member;

a sheet regulating unit pivotably attached to the rotating member holding unit at a first pivot point and configured to regulate the sheet stacked on the stacking unit; and a stopper portion configured to pivot at a second pivot point and abut against the sheet regulating unit below the first pivot point, from a side opposing the stacking unit with respect to the sheet regulating unit in a conveyance direction, the stopper portion further configured to regulate rotation of the sheet regulating unit about the first pivot point, wherein when the pickup rotating member is moved from the feeding retracted position to the feeding position, the first pivot point of the sheet regulating unit moves away from the second pivot point of the stopper portion.

10. The sheet feeding apparatus according to claim 1, further comprising a frame, wherein the stopper portion is provided on the frame.

11. The sheet feeding apparatus according to claim 1, wherein the stopper is not in contact with the sheet regulating unit when the rotating member holding unit is in the feeding position.

12. The sheet feeding apparatus according to claim 1, wherein the rotating member holding unit is configured to move in a direction away from the stopper when moving from the feeding retracted position to the feeding position.

13. The sheet feeding apparatus according to claim 1, wherein the sheet regulating unit is configured to inhibit the sheet stacked on the stacking unit from moving downstream in the feeding retracted position, and control the sheet stacked on the stacking unit from moving downstream in the feeding position.

* * * * *